US005145362A

United States Patent [19]

Obermueller

[11] Patent Number: 5,145,362

[45] Date of Patent: Sep. 8, 1992

[54] APPARATUS FOR BURNING POLLUTANTS CONTAINED IN A CARRIER FLOW

[75] Inventor: Herbert Obermueller, Linsengericht, Fed. Rep. of Germany

[73] Assignee: H. Krantz GmbH & Co., Aachen, Fed. Rep. of Germany

[21] Appl. No.: 667,513

[22] Filed: Mar. 11, 1991

[30] Foreign Application Priority Data

Mar. 10, 1990 [DE] Fed. Rep. of Germany ..... 4007628

[51] Int. Cl.[5] ..... F23J 15/00

[52] U.S. Cl. ..... 432/72; 432/152; 110/211; 110/214

[58] Field of Search ..... 432/72, 152; 110/204–206, 211, 214

[56] References Cited

U.S. PATENT DOCUMENTS

| | | | |
|---|---|---|---|
| 3,898,040 | 8/1975 | Tabak | 110/211 |
| 3,947,235 | 3/1976 | Bornet | 432/72 |
| 4,098,567 | 7/1978 | Hubbert | 432/72 |
| 4,771,707 | 9/1988 | Robson et al. | 432/72 |
| 4,830,610 | 5/1989 | Hemsath | 432/152 |
| 4,906,182 | 3/1990 | Moller | 432/152 |

*Primary Examiner*—Henry C. Yuen
*Attorney, Agent, or Firm*—W. G. Fasse

[57] ABSTRACT

An apparatus for burning pollutants in a carrier gas flow such as exhaust gases, is constructed as a compact unit. For this purpose a radial blower for the supply of the carrier gas which carries the pollutants is arranged directly in an inlet chamber of the gas cleaning apparatus. The inlet port of the inlet chamber is connected through a duct to the suction inlet of the radial blower. The compression outlet of the radial blower leads into a ring gap which in turn opens radially into the inlet chamber. For this purpose, the radial blower is enclosed by a blower housing which is arranged concentrically at one end of the housing opposite the burner arranged at the other end of the housing. The drive motor for the radial blower is mounted directly on the outside to an end wall of the housing of the apparatus.

8 Claims, 1 Drawing Sheet

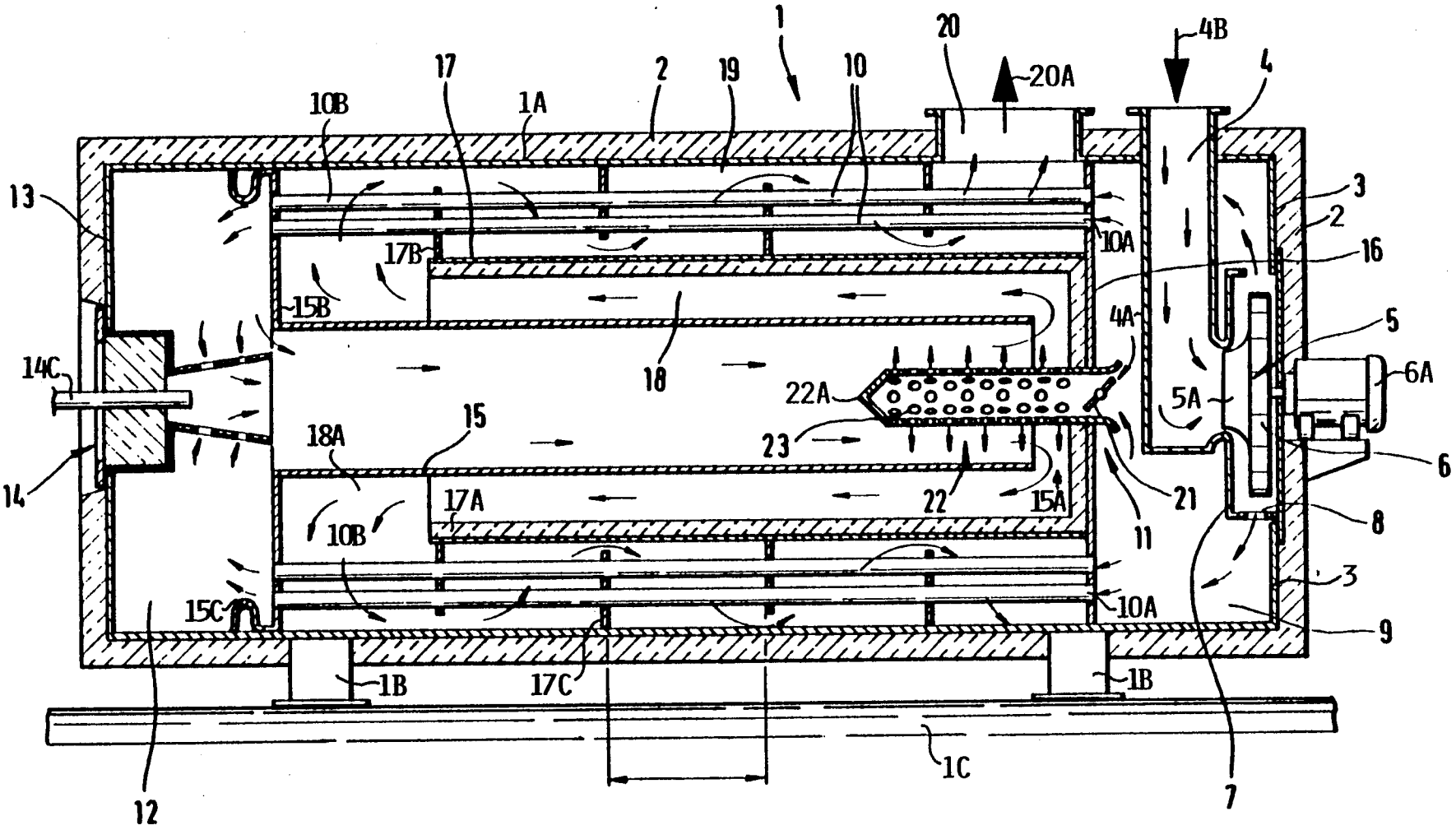
1
1A
1B
1C
2
3
4
4A
4B
5
5A
6
6A
7
8
9
10
10A
10B
11
12
13
14
14C
15
15A
15B
15C
16
17
17A
17B
17C
18
18A
19
20
20A
21
22
22A
23

APPARATUS FOR BURNING POLLUTANTS CONTAINED IN A CARRIER FLOW

CROSS-REFERENCE TO RELATED APPLICATIONS

The present invention relates to the following U.S. patent applications:

Ser. No. 07/667,517, Filed: Mar. 11, 1991;
Ser. No. 07/667,514, Filed: Mar. 11, 1991;
Ser. No. 07/667,516, Filed: Mar. 11, 1991.

FIELD OF THE INVENTION

The invention relates to an apparatus for burning pollutants contained in a carrier flow, such as an exhaust gas flow.

BACKGROUND INFORMATION

Such devices comprise a cylindrical housing with an inlet port leading into an inlet chamber and an exit port for the discharge of the cleaned gas flow. The contaminated gas flow is fed into the inlet chamber which in turn supplies the gas to be cleaned through heat exchanger pipes into a ring combustion chamber. The heat exchanger pipes are arranged cylindrically and axially in the cylindrical housing. These heat exchanger pipes thus form a ring-shaped or cylindrical bundle. The ring combustion chamber encloses at a facing end of the housing a burner which discharges into a flue gas mixing pipe arranged concentrically in the housing. The flue gas mixing pipe in turn leads into a main combustion chamber which passes into a ring chamber leading into the exit port, whereby the cleaned gas flows around the heat exchanger pipe for preheating the gas to be cleaned before it enters into the ring combustion chamber around the burner.

A gas cleaning apparatus as just described requires an external feeding mechanism in the form of a blower for charging the contaminated carrier gas through conduit pipes connected to the inlet chamber of the apparatus. Flaps for controlling the alternative operation with fresh air or for admixing fresh air to the contaminated gas must always be arranged on the suction side of the blower for the contaminated gas. Therefore, these flaps and any mixing devices are to be arranged together with the blower away from the cleaning apparatus. In some instances, the flaps are even arranged further away from the cleaning apparatus than the blower. Frequently, the blower and the additional components for the admixture of fresh air are located in a building while the combustion apparatus for the cleaning of the exhaust gases itself is assembled outside the building.

The alternative operation air, for example, for a start-up operation, for an admixing operation, or for the so-called "stand-by" operation, must always be available. Additionally, such operation air is often required as rather substantial air volumes. Accordingly, if the blower is installed in a building, additional pipe conduits must be installed if the alternative operation air must be sucked in from the outside. Thus, generally, the effort and expense for the installation of the so-called peripheral components of such cleaning plants inside a building is substantial. Available mounting space is required and scaffolds as well as frame structures, must be built, often requiring pipe conduits of substantial length and large cross-section requiring respective heat insulations. Last, but not least, noise insulating measures are unavoidable. The space requirement often encroaches on the actual production systems which in fact must be considered to be more important than the peripheral equipment.

Additionally, these blowers generate a substantial noise which causes a substantial nuisance, because usually these blowers are rather loud high performance blowers. The body noise of such blowers can be insulated with a relatively reasonable effort. However, the air noise caused by these blowers can be kept in permissible limits only with a substantial effort and expense. The conventional, slotted blowout curtains cannot be used in this instance because the slots would be contaminated by the pollutants, by soot, and other materials contained in the carrier gas. Additionally, these co-called blow-out curtains are not capable of withstanding the exhaust gas temperatures. Moreover, the required flexible, that is noise-open connections, on the compression side of the blower, do not permit the use of a so-called slotted blow-out curtain. In view of the foregoing, the entire conventional system, including the combustion plant, and the peripheral components, are altogether very expensive.

OBJECT OF THE INVENTION

In view of the above it is the aim of the invention to achieve the following objects singly or in combination:

to construct a gas cleaning apparatus of the type described above in such a way that it requires altogether less space and so that it can be produced and installed at substantially less expense than was possible heretofore;

to optimally reduce the need for peripheral equipment, including conduit ducts, noise insulating equipment, and heat insulating means;

to construct the apparatus so that its assembly can be substantially accomplished at the site of its production, thereby minimizing installation costs at the place of use;

to install the drive motor for the blower in such an apparatus, so that the drive motor will not be exposed to the influences of the gases to be cleaned; and to uniformly mix the gases to be cleaned in the inlet chamber and to charge the gases to be cleaned uniformly into the inlet ends of the heat exchanger pipes.

SUMMARY OF THE INVENTION

The above objects have been achieved in an apparatus according to the invention, which is characterized in that the inlet port of the apparatus is connected to the suction inlet of a blower and the compression exit or outlet of the blower leads into the inlet chamber of the apparatus to which the heat exchanger pipes are connected with their inlet ends. Preferably, the blower is arranged at one end of the cylindrical housing and the burner is arranged at the opposite end of the cylindrical housing concentrically with the central longitudinal axis of the housing of the apparatus.

The invention integrates the blower for conveying the gas to be cleaned in the cylindrical housing, thereby achieving numerous advantages compared to conventional gas cleaning devices. For example, a special installation area or space in a building for the blower is no longer necessary. As a result, pipe conduits or ducts between the blower and the cleaning apparatus are avoided along with all costs connected therewith including costs heretofore required for any structural changes at the installation site. The invention also minimizes the required heat insulation as well as expenses for inspection and maintenance. By arranging the gas conveying apparatus or blower in the inlet chamber located at one end of the housing opposite of the burner which is arranged at the other end of the housing, it is no longer necessary to provide a separate heat insulation for the blower. Another advantage is seen in that by arranging the blower inside the inlet chamber it is no longer necessary to provide a noise insulation. Blow-out noises at the compression exit of the blower are also muzzled or damped by the large mass of heat exchanger pipes arranged on the compression side of the blower.

Further advantages are seen in that the formation of condensation due to heat losses on the surface components of the blower are avoided because the blower and its suction inlet duct are arranged inside the housing, or rather inside the inlet chamber of the housing so that these blower components are heated in an optimal manner. It has been found that the blower and its suction inlet remain sufficiently heated even when operating with fresh air during the start-up operation of the apparatus and also during any stand-by operation. Apparently, there is sufficient radiation heat available from the combustion chamber, or if such heat is not available, it can be readily produced to the required extent. As a result, the apparatus according to the invention provides sufficient temperatures even after prolonged standstill times to permit a rapid switching to an operation for cleaning exhaust gases. Further, due to the fact that the exhaust gas conducting pipe conduits operate under reduced pressure all the way into the housing, a leakage in these pipe conduits is neither dangerous nor a nuisance.

The apparatus according to the invention can be constructed in a very compact form so that a substantially operational apparatus can be preassembled at the manufacturing location. As a result, substantial assembly costs at the place of use can be avoided.

According to the invention, the blower is preferably a radial blower, the drive motor of which is arranged on the outside facing end surface of the housing. This arrangement of the radial blower inside the inlet chamber and its drive outside of the housing keeps the blower at temperatures which prevent condensation on blower components while the drive motor is entirely withdrawn from any influences of the gases to be cleaned.

Preferably, the propeller of the radial blower is enclosed by a housing inside the inlet chamber. The compression outlet of the radial blower is formed by a ring gap opening radially into the inlet chamber. This type of arrangement of the radial blower makes sure that an intensive mixing of the gas to be cleaned takes place in the relatively large space of the inlet chamber so that the gas to be cleaned is uniformly distributed throughout the volume of the inlet chamber and so that all heat exchanger pipes are charged with the gas to be cleaned with a uniform compression and with a uniform volume flow in each individual heat exchanger pipe.

The inner diameter of the inlet chamber and the diameter of the housing for the radial blower are so dimensioned relative to each other, that a substantial spacing is provided between the radially outwardly facing ring gap of the blower housing and the cylindrical inner wall of the inlet chamber. Such a sufficient radial spacing makes sure that the mixing of the incoming gases to be cleaned is effective and that the gas is uniformly distributed over the entire volume of the inlet chamber.

BRIEF DESCRIPTION OF THE DRAWING

The single FIGURE shows an axial sectional view through the present gas cleaning apparatus.

DETAILED DESCRIPTION OF PREFERRED EXAMPLE EMBODIMENTS AND OF THE BEST MODE OF THE INVENTION

Referring to the single FIGURE the present gas cleaning apparatus comprises a housing 1 including a cylindrical metal shell 1A surrounded by heat insulation 2. The right-hand end is closed by an end wall 3. The left-hand end is closed by an end wall 13. An inlet port 4 leads through an inlet duct 4A to the intake 5A of a radial blower 5 mounted concentrically in the end wall 3. The radial blower 5 has a propeller wheel 6 driven by a motor 6A for blowing the incoming gas indicated by an arrow 4B radially outwardly through a ring gap or slot 8 in a housing 7 surrounding the radial blower 5. The slot 8 leads into an inlet chamber 9 of the housing 1. The inlet chamber 9 is closed by a radially extending separation wall 16 provided with holes into which the inlet ends 10A of the heat exchanger pipes 10 are welded or brazed.

As shown in the drawing, a by-pass 11 is concentrically mounted in the separation wall 16. The by-pass 11 comprises a pipe section 22 with apertures 23 in its wall at least where the pipe section 22 reaches into a flue gas mixing pipe 15 to be described below. The apertures 23 may also be provided in the pipe section 22 where the pipe section passes through a spacing 15A between the right-hand open end of the flue gas mixing pipe 15 and the separation wall 16. The right-hand end of the by-pass pipe section 22 is open and reaches into the inlet chamber 9 which is enclosed by the heat insulation 2 of the housing 1. The left-hand end of the pipe section 22 has a closed bottom 22A which is preferably streamlined to face the flow inside the flue gas mixing pipe 15. A flow control device 21, such as a flap valve or double flap valve is located in the inlet end of the by-pass pipe section 22 for controlling the flow cross-sectional area into the by-pass 11.

The heat exchanger pipes 10 extend coaxially around a central axis of the cylindrical housing 1 and along a substantial proportion of the axial length of the housing. The exit end 10B of each heat exchanger pipe 10 is welded into a respective hole in an end flange 15B of the flue gas mixing pipe 15. Thus, the gas passing through the heat exchanger pipes 10 enters into a ring chamber 12 formed between the end wall 13 and the flange 15B. The ring chamber 12 is also enclosed by the heat insulation 2 of the housing 1 and a first combustion chamber which surrounds a burner 14 receiving fuel through a fuel pipe 14A. The burner is arranged concentrically in the first combustion chamber 12 and coaxially to the flue gas mixing pipe 15. Thus, the burner 14 opens into the pipe 15. The end flange 15B of the pipe 15 extends radially and has a corrugated collar 15C. The collar 15C performs three functions. First, it deflects the gas exiting from the heat exchanger pipe ends 10B toward the burner 14. Second, the collar 15C firmly supports the pipe 15 in the housing casing 1A which is mounted on brackets or legs 1B on a support 1C. Third, the corrugation of the collar 15C of the pipe 15 properly guides pipe 15 in the housing to accommodate heat expansions and contractions.

The right-hand open end of the flue gas mixing pipe 15 is spaced from the separation wall 16 by the above mentioned spacing 15A so that the gas exiting from the open end of the pipe 15 can enter into a second or main combustion chamber 18 formed between the pipe 15 and a cylinder 17 surrounding the pipe 15 with a radial spacing. The cylinder 17 is connected at its right-hand end to the separation wall 16 and the chamber thus formed is lined with heat insulation 15A. The cylinder 17 with its insulation 17A extends along a substantial length of the pipe 15, but is shorter than the pipe 15 to form a flow diverting ring chamber 18A in which the gas exiting from the main combustion chamber 18 is diverted to flow through a ring space 19 formed between the cylinder 17 and the jacket 1A of the housing 1. The heat exchanger pipes 10 are arranged in this ring space 19 for preheating the incoming gas to be cleaned before it is supplied into the ring chamber 12 around the burner 14. Baffle plates 17B and 17C extend into the ring space 19 to cause the exit flow to meander around the heat exchanger pipe 10 for an efficient heat exchange. The ring space 19 leads into an exit port 20 through which the cleaned gas is discharged as indicated at 20A.

The above mentioned control device or flap 21 in the by-pass 11 makes it possible to divert a controlled proportion of the gas to be cleaned directly into the combustion flow through the apertures 23, whereby the diverted proportion does not flow through the heat exchanger pipes 10 nor through the ring chamber 12 and also not through the burner 14. The diverted proportion is mixed with the flow in the flue gas mixing pipe 15, whereby the temperature of the gas in the pipe 15 and in the main combustion chamber 18 can be effectively controlled.

Referring further to the FIGURE, the cylindrical housing 1 has a longitudinal central axis and the burner 14 as well as the radial blower 5 are arranged concentrically relative to the central housing axis. The blower is arranged at one end while the burner is arranged at the opposite end concentrically in the combustion chamber 12. By mounting the drive motor 6A for the radial blower 5 outside the heat insulated end wall 3 of the housing 1, the motor is protected against excessive heat and contamination by the gases to be cleaned. The ring gap 8 in the housing 7 is radially spaced from the inwardly facing cylindrical wall of the inlet chamber 9 to permit a uniform volume distribution of the incoming gas throughout the volume of the chamber 9. Preferably, the ring gap 8 is arranged as close as possible to the inwardly facing surface of the end wall 3. The motor 6A is preferably mounted coaxially relative to a central longitudinal axis of the housing 1 as shown in the FIGURE.

By arranging the radial blower 5 with its cylindrical housing 7 concentrically in the chamber 9, the ring gap 8 is also concentrically positioned in the inlet chamber 9 so that the above mentioned uniform gas distribution and pressurerization of the inlet chamber is enhanced.

Although the invention has been described with reference to specific example embodiments it will be appreciated that it is intended to cover all modifications and equivalents within the scope of the appended claims.

What I claim is:

1. An apparatus for burning pollutants out of a carrier gas flow, comprising a housing having a heat insulated wall with an inlet port (4) for said carrier gas flow (4B) and an outlet port (20) for cleaned gas (20A), gas flow path means arranged in the following sequence in said housing and including an inlet chamber (9) enclosed by said heat insulating wall at one end of said housing, heat exchange pipes having open ends for receiving gas to be cleaned from said inlet chamber, a first combustion chamber (12) also enclosed by said heat insulating housing wall at an opposite end of said housing for receiving preheated gas through said heat exchange pipes (10), a burner (14) in said first combustion chamber opposite said inlet chamber (9), a flue gas mixing pipe (15) arranged coaxially with said burner, said flue gas mixing pipe having an open inlet end facing said burner, a second combustion chamber (18) surrounding said flue gas mixing pipe, said second combustion chamber (18) having an inlet communication with an open outlet end of said flue gas mixing pipe opposite said burner, a heat exchange space wherein said heat exchange pipes are arranged, said heat exchange space surrounding said second combustion chamber (18) and communicating with said second combustion chamber and with said outlet port (20) for discharging cleaned gas, blower means (5) centrally mounted in said inlet chamber, said blower means (5) having a central suction inlet and a radial compression outlet, inlet duct means (4A) connecting said inlet port through said heat insulated wall centrally to said suction inlet (5A) of said blower means (5), whereby said inlet duct means operate under reduced pressure, said compression outlet of said blower means leading a compressed carrier gas flow radially outwardly into said inlet chamber which diverts said carrier gas flow axially for supplying carrier gas to be cleaned under compression uniformly into said receiving open ends of said heat exchange pipes (10) having outlet ends leading into said first combustion chamber (12).

2. The apparatus of claim 1, wherein said housing is cylindrical and said blower means is arranged concentrically in said inlet chamber (9) on an inside surface of a first heat insulated end wall of said cylindrical housing axially closing said inlet chamber, and wherein said burner is arranged concentrically in said combustion chamber on a second opposite heat insulated end wall of said cylindrical housing closing said first combustion chamber (12).

3. The apparatus of claim 2, wherein said blower means comprises a radial blower and a drive motor for said radial blower, and means mounting said drive motor on an outside surface of said first heat insulated end wall of said housing, whereby said drive motor is optimally spaced away from said burning and protected against heat and contamination by said first heat insulated end wall, said heat insulated housing wall further providing noise insulation for said blower means inside said inlet chamber (9).

4. The apparatus of claim 1, further comprising a blower housing enclosing said radial blower inside said inlet chamber, said blower housing having a radially opening ring gap forming said compression outlet for said radial blower in said inlet chamber for radially discharging carrier gas into said inlet chamber, to assure a uniform volume flow of gas to be cleaned in each heat exchange pipe.

5. The apparatus of claim 4, wherein said blower housing is arranged concentrically in said inlet chamber so that said ring gap is also positioned concentrically in said inlet chamber in said cylindrical housing, and so that a radial spacing is provided between said ring gap and a radially inwardly facing cylindrical wall of said inlet chamber for diverting radially flowing carrier gas into an axial direction toward an open inlet end of said heat exchanger pipes.

6. The apparatus of claim 5, wherein said ring gap is located next to said inside surface of said first heat insulated end wall of said inlet chamber for guiding said carrier gas flow radially.

7. The apparatus of claim 1, further comprising a separation wall (16) separating said inlet chamber from said open end of said flue gas mixing pipe (15) and from said main combustion chamber (18), a flow bypass (11) mounted in and passing through said separation wall (16) for introducing a portion of said carrier gas flow through said bypass (11) from said inlet chamber directly into said flue gas mixing pipe (15).

8. The apparatus of claim 1, wherein said flue gas mixing pipe (15) has an end flange (15B) with a corrugated collar (15C) for mounting said flue gas mixing pipe in said housing.

* * * * *

UNITED STATES PATENT AND TRADEMARK OFFICE

CERTIFICATE OF CORRECTION

PATENT NO. : 5,145,362

DATED : September 8, 1992

INVENTOR(S) : Herbert Obermueller

It is certified that error appears in the above-identified patent and that said Letters Patent is hereby corrected as shown below:

Claim 1, (Col. 6, line 14), replace "communication" by --communicating--.

Claim 3, (Col. 6, line 49), replace "burning" by --burner--.

Claim 4, (Col. 6, line 54), replace "claim 1" by --claim 3--.

Signed and Sealed this

Twenty-first Day of September, 1993

Bruce Lehman

*Attest:*

BRUCE LEHMAN

*Attesting Officer*

*Commissioner of Patents and Trademarks*